US008915712B2

(12) United States Patent
Itzel et al.

(10) Patent No.: US 8,915,712 B2
(45) Date of Patent: Dec. 23, 2014

(54) HOT GAS PATH COMPONENT

(75) Inventors: Gary Michael Itzel, Simpsonville, SC (US); Dipankar Pal, Greenville, SC (US)

(73) Assignee: General Electric Company, Schenectady, NY (US)

( * ) Notice: Subject to any disclaimer, the term of this patent is extended or adjusted under 35 U.S.C. 154(b) by 781 days.

(21) Appl. No.: 13/164,113

(22) Filed: Jun. 20, 2011

(65) Prior Publication Data

US 2012/0317987 A1 Dec. 20, 2012

(51) Int. Cl.
*B22D 46/00* (2006.01)
*F01D 5/18* (2006.01)

(52) U.S. Cl.
CPC ..... *F01D 5/187* (2013.01); *F05D 2240/81* (2013.01); *F05D 2260/202* (2013.01); *F05D 2260/22141* (2013.01)
USPC ..... 416/97 R; 415/115

(58) Field of Classification Search
CPC ..... F01D 5/186; F01D 5/187; F01D 25/08
USPC ..... 415/115; 416/95, 96 R, 96 A, 97 R
See application file for complete search history.

(56) References Cited

U.S. PATENT DOCUMENTS

| | | | | |
|---|---|---|---|---|
| 3,800,864 | A | 4/1974 | Hauser et al. | |
| 5,197,852 | A | 3/1993 | Walker et al. | |
| 5,382,135 | A * | 1/1995 | Green | 416/97 R |
| 5,413,458 | A | 5/1995 | Calderbank | |
| 5,609,466 | A | 3/1997 | North et al. | |
| 6,243,948 | B1 * | 6/2001 | Lee et al. | 29/889.1 |
| 6,974,308 | B2 * | 12/2005 | Halfmann et al. | 416/97 R |
| 7,695,247 | B1 * | 4/2010 | Liang | 416/97 R |
| 7,901,182 | B2 * | 3/2011 | Liang | 416/97 R |
| 8,172,505 | B2 * | 5/2012 | Fujimoto et al. | 415/115 |
| 2008/0190114 | A1 * | 8/2008 | Surace et al. | 60/806 |

FOREIGN PATENT DOCUMENTS

| | | |
|---|---|---|
| EP | 1074696 A | 2/2001 |
| EP | 1726785 A | 11/2006 |
| EP | 2469034 A | 6/2012 |

OTHER PUBLICATIONS

"Film Cooling"; published from "Gas Turbine Handbook" in 2006.*
Search Report and Written Opinion from EP Application No. 12172488.4 dated Aug. 30, 2012.

* cited by examiner

*Primary Examiner* — Ned Landrum
*Assistant Examiner* — Justin Seabe
(74) *Attorney, Agent, or Firm* — Cantor Colburn LLP

(57) ABSTRACT

A hot gas path component is provided and includes a body having a surface and being formed to define a cavity, the cavity employing coolant flow through a pin-fin bank with coolant discharge through film-cooling holes defined on the surface, the pin-fin bank including first and second pluralities of pin-fins, the first plurality of pin-fins and the second plurality of pin-fins each being aligned with a determined flow streamline, and any two pin-fins of the first and second pluralities of pin-fins being separated from one another by a gap as a function of a film-cooling hole dimension.

11 Claims, 2 Drawing Sheets

HOT GAS PATH COMPONENT

BACKGROUND OF THE INVENTION

The subject matter disclosed herein relates to a turbine engine airfoil and, more particularly, to a turbine engine airfoil with a pin-bank alignment for film-cooling design.

The current usage of pin-fins and film-cooling holes in gas turbine component cooling, especially in complex end-wall cooling configurations, is not provided so that film-cooling can be most effective for a given arbitrarily arranged pin-fin structure in a typically cast cavity of a gas path component. As such, it is difficult to place film-cooling holes on the hot surface of the gas path component due to film-cooling hole drilling restrictions for existing pin-fin arrays in the underlying coolant cavity. Thus, film-cooling holes are typically drilled at locations where they do not interfere with the pin-fin structure but do not necessarily provide for the most efficient film-cooling. Therefore, film effectiveness on the hot-surface is often non-optimal for given gas-flow conditions.

BRIEF DESCRIPTION OF THE INVENTION

According to one aspect of the invention, a hot gas path component is provided and includes a body having a surface and being formed to define a cavity, the cavity employing coolant flow through a pin-fin bank with coolant discharge through film-cooling holes defined on the surface, the pin-fin bank including first and second pluralities of pin-fins, the first plurality of pin-fins and the second plurality of pin-fins each being aligned with a determined flow streamline, and any two pin-fins of the first and second pluralities of pin-fins being separated from one another by a gap as a function of a film-cooling hole dimension.

According to another aspect of the invention, a gas turbine is provided and includes an airfoil end wall structure having a surface and being formed to define a cavity, the cavity employing coolant flow through a pin-fin bank with coolant discharge through film-cooling holes defined on the surface, the pin-fin bank including first and second pluralities of pin-fins, the first plurality of pin-fins and the second plurality of pin-fins each being aligned with a determined flow streamline along the surface, and any two pin-fins of the first and second pluralities of pin-fins being separated from one another by a gap as a function of a film-cooling hole dimension.

According to yet another aspect of the invention, a method of forming a hot gas path component is provided and includes modeling the hot gas path component, determining a flow streamline along a surface of the modeled hot gas path component and casting the modeled hot gas path component with a pin-fin bank including first and second pluralities of pin-fins, the first plurality of pin-fins and the second plurality of pin-fins each being aligned with the determined flow streamline.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
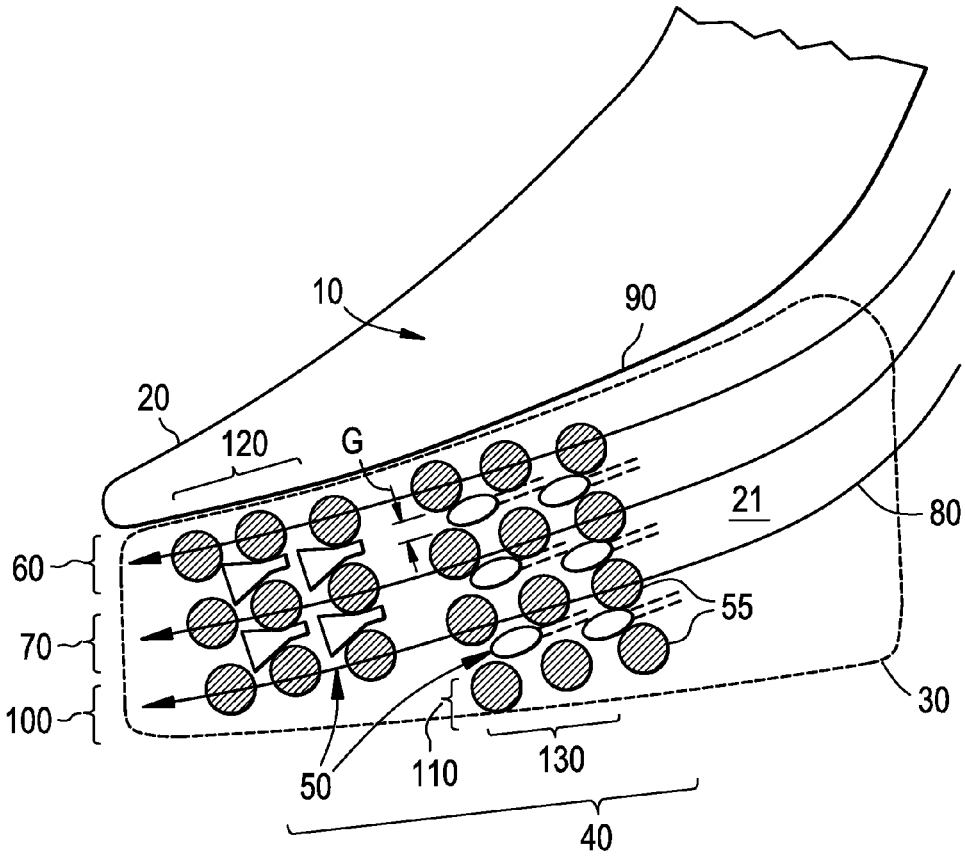
FIG. 1 is a schematic view of a hot gas path component.

With reference to FIG. 1, a hot gas path component 10 is provided. The hot gas path component 10 includes a body 20 having a surface 21. The body 20 is formed to define a cavity 30 therein. The cavity 30 employs coolant flow to cool the body 20 through a pin-fin bank 40 with coolant discharge to the surface 21 being permitted through film-cooling holes 50. The film-cooling holes 50 are defined on the surface 21 between individual pin-fins 55 of the pin-fin bank 40.

In particular, the film-cooling holes 50 are defined on the surface 21 at a predefined film-hole centerline that provides the best cooling benefit, based on analysis, for topography of a given surface 21. Since optimal film-hole centerline locations would not be known, after the body 20 is formed (i.e., cast), it is necessary to provide space between the individual pin-fins 55 of the pin-fin bank 40 during the forming process. The film-cooling holes 50 can then be formed at a later time once the predefined film-hole centerline is ascertained in the space between the individual pin-fins 55. This later forming of the film-cooling holes 50 allows for tunable film cooling based on engine/test data without requiring, for example, a casting change and provides for relatively non-restricted film-cooling hole locations.

The pin-fin bank 40 includes at least a first plurality of pin-fins 60 and a second plurality of pin-fins 70. The first plurality of pin-fins 60 and the second plurality of pin-fins 70 are each substantially and respectively aligned in parallel with a determined flow streamline 80, which describes an external gas flow velocity vector and which is known at a time the body 20 is formed. Any two individual pin-fins 55 of the first and/or the second pluralities of pin-fins 60, 70 are separated from one another by at least a gap, G. The gap, G, is determined as a function of at least a dimension of one or more of the film-cooling holes 50 in a direction substantially perpendicular to the determined flow streamline 80.

The surface 21 may include a surface of an airfoil end wall structure of a gas turbine engine with the first plurality of pin-fins 60 being arranged proximate to an edge 90 of an airfoil footprint on an end wall and the second plurality of pin-fins 70 being arranged on a side of the first plurality of pin-fins 60 facing away from the edge 90. The pin-fin bank 40 may further include additional pluralities of pin-fins, such as third plurality of pin-fins 100 and fourth plurality of pin-fins 110. In addition, the pin-fin bank 40 may include a first set of pin-fins 120 and a second set of pin-fins 130, which are separated from one another by a predefined distance that is at least as large as the gap, G, along the determined flow streamline 80.

The gap, G, is determined as a function of at least the dimension of one or more of the film-cooling holes 50 and at least one or more of the true position of the individual pin-fins 55 and film-cooling holes 50. The film-cooling holes 50 may have polygonal, trapezoidal, elliptical or other similar shapes. The dimensions of the one or more of the film-cooling holes 50 by which the gap, G, is determined may be a film-cooling hole diameter. Also, a film-cooling hole diffuser spread angle may be provided to cover pin-fin widths. This allows for potential film-cooling of any portion of the pin-fin bank 40 as needed without requiring, for example, a casting change.

Figure 2:
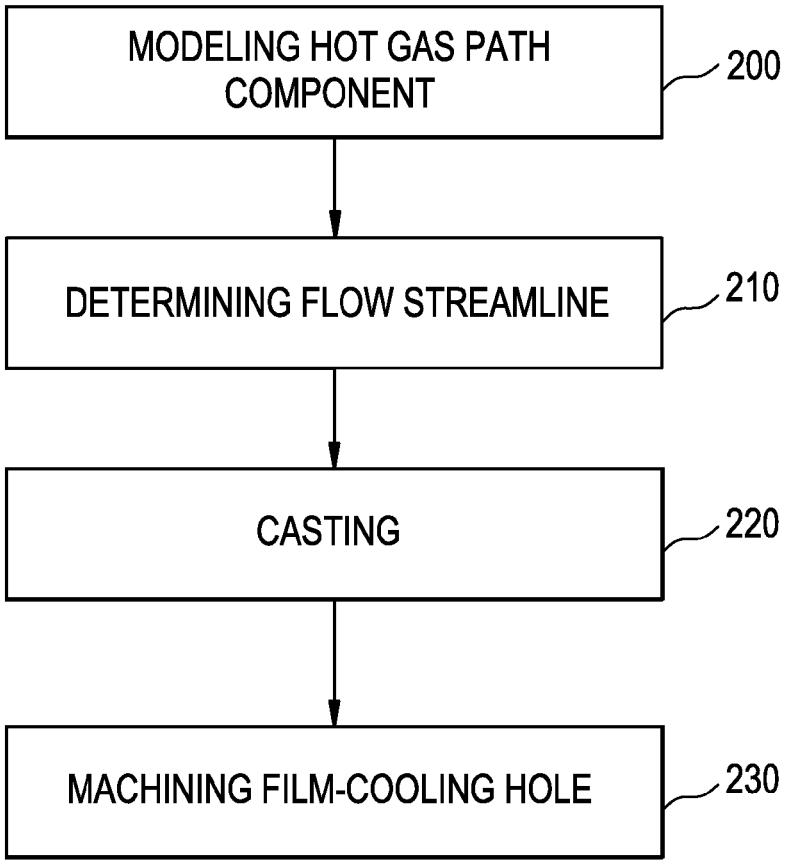
FIG. 2 is a flow diagram illustrating a method of forming a hot gas path component.

With reference to FIG. 2, a method of forming a hot gas path component 10 is provided. The method includes modeling 200 a shape of the hot gas path component 10, determining 210 the flow streamline 80 along the surface 21 of the modeled hot gas path component 10, and casting 220 the modeled hot gas path component 10. The casting 220 includes casting of the pin-fin bank 40 including first and second pluralities of pin-fins 60, 70, where the first plurality of pin-fins 60 and the second plurality of pin-fins 70 are each substantially and respectively aligned with the determined flow streamline 80. The casting 220 may include separating any two individual pin-fins 55 of the first and second pluralities of pin-fins 60, 70 by a gap, G, as a function of a film-cooling hole dimension where the film-cooling hole dimension may be a film-cooling hole diameter.

Once the casting is complete, the alignment of the pin-fin bank 40 and the separation between individual pin-fins 55 allows for the tunable film cooling based on engine/test data without requiring, for example, casting changes and provides for relatively non-restricted film-cooling hole locations. As such, the method further includes machining 230 a film-cooling hole 50 at a predefined position wherein the machining may include, for example, machining the film-cooling hole 50 to have a polygonal, trapezoidal shape, an elliptical shape or another similar shape.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A hot gas path component, comprising:

a body having a surface and being formed to define a cavity, the cavity employing coolant flow through a pin-fin bank with coolant discharge through film-cooling holes defined on the surface, the pin-fin bank including first and second pluralities of pin-fins, the first plurality of pin-fins and the second plurality of pin-fins each being aligned with a determined flow streamline, and any two pin-fins of the first and second pluralities of pin-fins being separated from one another by a gap as a function of a film-cooling hole dimension, wherein the film-cooling holes are each defined at the surface of the body as having a frusto-conical portion and a rectangular portion at a narrow end of the frusto-conical portion at the surface.

2. The hot gas path component according to claim 1, wherein the surface comprises a surface of an airfoil end wall structure.

3. The hot gas path component according to claim 1, wherein the film-cooling hole dimension is a film-cooling hole thickness at the rectangular portion.

4. A component of a gas turbine engine, comprising:

an airfoil end wall structure having a surface and being formed to define a cavity, the cavity employing coolant flow through a pin-fin bank with coolant discharge through film-cooling holes defined on the surface to have a frusto-conical portion and a rectangular portion at a narrow end of the frusto-conical portion at the surface, the pin-fin bank including first and second pluralities of pin-fins, the first plurality of pin-fins and the second plurality of pin-fins each being aligned with a determined flow streamline along the surface, and any two pin-fins of the first and second pluralities of pin-fins being separated from one another by a gap as a function of a film-cooling hole dimension.

5. The component of the gas turbine engine according to claim 4, wherein the film-cooling hole dimension is a film-cooling hole thickness at the rectangular portion.

6. The component of the gas turbine engine according to claim 4, wherein the first plurality of pin-fins and the second plurality of pin-fins are each aligned in parallel with the determined flow streamline along a substantial entirety of the surface.

7. The component of the gas turbine engine according to claim 4, wherein any two pin-fins of the first and second pluralities of pin-fins are separated from one another by a gap that is wider than the rectangular portion and narrower than a wide end of the frusto-conical portion.

8. A method of forming a hot gas path component, comprising:

modeling the hot gas path component;

determining a flow streamline along a surface of the modeled hot gas path component; and casting the modeled hot gas path component with a pin-fin bank including first and second pluralities of pin-fins, the casting comprising separating any two pin-fins of the first and second pluralities of pin-fins by a gap as a function of a dimension of a film-cooling hole having a frusto-conical portion and a rectangular portion at a narrow end of the frusto-conical portion at the surface of the modeled hot gas path component, the first plurality of pin-fins and the second plurality of pin-fins each being aligned with the determined flow streamline.

9. The method according to claim 8, wherein the film-cooling hole dimension is a film-cooling hole thickness at the rectangular portion.

10. The method according to claim 8, further comprising machining the film-cooling hole.

11. The method according to claim 8, further comprising:

sectioning the first plurality of pin-fins into first and second sets and sectioning the second plurality of pin-fins into first and second sets;

separating any two pin-fins of the first and second pluralities of pin-fins by a first gap as the function of the film-cooling hole dimension; and separating the first sets from the second sets by a second gap, which is larger than the first gap.

* * * * *